United States Patent [19]

Wilson

[11] Patent Number: 5,064,117

[45] Date of Patent: Nov. 12, 1991

[54] DOMESTIC BOILER FEED WATER GRAVITY SUPPLY

[76] Inventor: Robert A. Wilson, 10 Hillside Pl., Cranford, N.J. 07016

[21] Appl. No.: 317,687

[22] Filed: Mar. 1, 1989

[51] Int. Cl.[5] ..... F24D 1/00

[52] U.S. Cl. ..... 237/67; 122/37

[58] Field of Search ..... 237/67, 70, 8 R, 8 C, 237/58, 66, 64, 73, 8 A, 6, 12.8, 71, 72, 74, 75, 9 R; 122/37

[56] References Cited

U.S. PATENT DOCUMENTS 361,350 4/1887 Denslow ..... 237/67

3,265,304 8/1966 Gatza ..... 237/67

*Primary Examiner*—Henry A. Bennet

[57] ABSTRACT

The instant invention is best described as an arrangement of equipment and piping that will supply boiler feed water to a domestic steam heating unit without system sensors and mechanical devices within the finite capacity of the reservoir. Equipment to provide boiler water on this basis is not available so far as is known. Additional water for the reservoir is supplied manually as needed.

1 Claim, 1 Drawing Sheet

DOMESTIC BOILER FEED WATER GRAVITY SUPPLY

A SUMMARY OF THE INVENTION

A process and apparatus is proposed to maintain a safe water level in a domestic Steam Heating Furnace. An external reservoir elevated at the proper elevation will by gravity feed water as required by boiler operation. When boiler operation is begun water level in the gage glass is lowered without system loss with the start of the firing cycle due to differential system pressure. Also during operation, some water is lost during intermittent air venting. If the water level is lowered beyond a set limit during these normal operations, the system will automatically be shut down by a low water cut off device (a normal safety device on all or most steam plants). This proposed equipment and arrangement will supply make up water by gravity when required without the addition of other pressure or level sensing instruments. Also when the system cycle is complete and displaced boiler water is returned to the boiler by gravity correct water level is still maintained by providing for its return from which it came.

DESCRIPTION OF DRAWING FIG. 1

The single drawing which forms a part of the patent application shows a schematic elevation of a modern Steam Heating Furnace 9 and the important parts concerning said invention. Illustrated parts 1, 2, 3 are the prime parts of invention. Part 1 is a pressure reservoir set at the critical elevation relative to gage glass 4 and parts 2, 4 are piping connecting to the boiler at points 5, 6. All other indentifed parts in the drawing are standard on all steam home heating equipment.

DETAILED DESCRIPTION OF THE INVENTION AND EQUIPMENT

Modern domestic steam heating systems are designed with the minimum practical amount of water in the steam generation zone for prompt supply of home heat. Also in modern systems a small amount of steam vapor is continuously lost to the home atmosphere through the action of the vent valves on each radiator. This loss of boiler water by the radiators venting a small amount of air/steam to permit uniform home heating must be replaced. If water loss is not eventually replaced, the boiler operation will be automatically shut down by the unit low water cut-off—item 7 shown in FIG. 1.

Automatic boiler make-up equipment is not commonly available for a domestic steam heating system. Sophisticated pressure and level sensors would be required to compensatee non-uniform pressure distribution so as to not overfill when water is merely displaced to other parts of the system by differential pressure. In this event even though the water glass indicates a lowered level, it is not required to add water to the system. The proposed system provides a water reservoir permitting water to flow in and out of the boiler to maintain safe levels.

When a signal is given to the boiler by the home thermostat to begin operation, the fired fuel will build steam pressure (in homes systems up to approximately 5 psig). This forces the boiler water into the condensate return piping due to uneven system pressure. This action will (if the starting water level was marginally low before operation was started), shut the furnace down by operation of the low water cut-off. If this shut down did not occur, the boiler may be damaged by a low water level.

For the above reason, a commonly available float-operated control to supply make up water from a pressurized source would not be satisfactory. With on/off cycling the system would eventually flood when dependent only upon float operated control valve. This would defeat the design of a furnace for quick response time for home heat demand.

The proposed external balanced feed reservoir will maintain safe water level for extended periods of operation beyond that designed into the furnace for minimum water in the steam generation zone.

The external reservoir does not depend upon pressure sensing or level control devices to maintain a safe water level. By providing a volume of water at a correct level not subject to generating steam, boiler water can be moved by pressure differentials, and small boiler water losses will not subject the boiler to cut off by the protective low water cut off 7. The improvement in boiler operating time between manual adding water to the system will depend upon the capacity of the external reservoir which will not affect the principal of minimum water in the steam generation zone for quick steam production.

BRIEF SUMMARY OF THE INVENTION

The instant invention is directed to apparatus and method to maintain a safe water level in a domestic steam heating boiler by use of an external supply of water. This quantity of water is pressure-balanced so that it will be automatically fed by gravity as needed.

In accordance with the instant invention, a pressure container 1 elevated to the correct height and connected with suitable piping 2 and 3, to the external boiler water piping 6 and 5 is filled with water so that the water thus contained will flow as needed to the boiler 9. Make up water from vessel 1 will by gravity replace water loss by operational venting. It should be noted that the automatic boiler water make-up is limited to the capacity of the external pressure container. Within practical limits the external container 1 could be any size (capacity) and hence would determine the frequency of manual refilling as operational system venting depletes boiler water. This apparatus and its operation is unique in that no pressure or level sensors are employed. The system is dependent on equipment placement and gravity with no moving parts.

BRIEF DESCRIPTION OF THE DRAWING

The invention may be better understood by reference to the accompanying drawings FIG. 1.

The drawing is a sectional elevation view of a typical modern gas fired domestic steam heating boiler. They are designed to contain the smallest practical amount of water in the steam generation zone.

DETAILED DESCRIPTION

Figure 1:
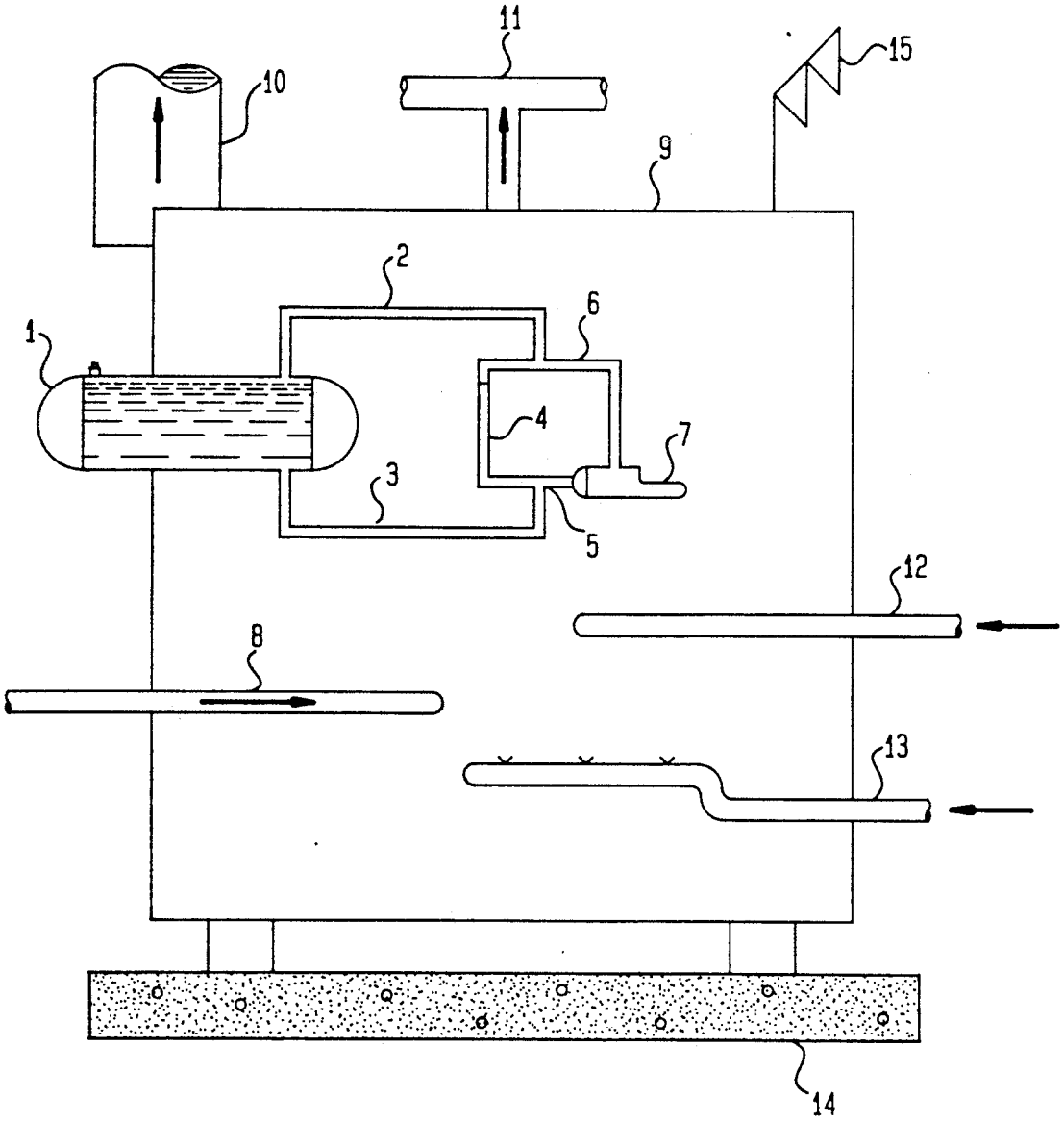

FIG. 1 illustrates a preferred embodiment of the instant invention applied to a modern domestic steam heating boiler. A portion of a typical domestic boiler 9 is illustrated in the sectional elevation view. Placed beneath the boiler is a concrete foundation 14 which provides support for the unit. The steam boiler normally is manually supplied by make up water as determined by the boiler sight glass 4. This non-instrumented water make up line 8 is supplied from a home supply system. Other parts of the boiler shown in the drawing are the furnace flue gas stack 10 and the gas fuel supply 13. Steam is supplied to the home radiator system via the steam header 11 and condensation is returned to the boiler through piping 12.

Shown in the drawing also are typical boiler water gage glass 4, the low water level cut off float 7, and a steam safety valve 15, connecting piping to these parts are shown.

An additional external reservoir 1 is required to be located at an exact elevation. The full water level must be at the same elevation as required by the manufacturer's water level indicated by gage glass 4. Pipe element 3 supplies water by gravity as needed connected at point 5. Piping element 2 (balance line) equalizes boiler steam pressure to external reservoir 1 to permit water to flow by gravity into the boiler through piping 3 as needed.

While the system has been described in detail, it should not be restricted by specific equipment details as changes in construction, combination, or arrangement of parts, may be made without departing from the spirit and scope of the invention.

I claim:

1. A water level maintenance system for a steam generating boiler in a home heating steam heating system said water level maintenance system comprising a steam generating boiler with a water level measuring device that supplies steam to radiators for home heating said radiators having a return conduit leading directly back to said stem generating boiler, an external water tank having a water level and said external tank being external of said steam generating boiler, said external tank is positioned in a vertical location such that the water level in the external tank and the water level in the steam generation boiler are at the same level when the heating system is operating in a steady state condition, said external tank having an unrestricted pipe extending from its top to the top of the said steam generating boiler water level measuring device and said external tank having an unrestricted pipe from its bottom to the bottom of the steam generating boiler water level measuring device, said external tank having a water capacity that causes the flow of water by gravity from the external tank by way of the external tank bottom conduit to the steam generation boiler when the steam generating boiler water level drops below the level of the water level of the external tank, said external tank also receives a flow of water from the steam generating system by way of pipe connected to the bottom of the steam generating boiler.

* * * * *